US005340116A

United States Patent [19]

Reinart

[11] Patent Number: 5,340,116

[45] Date of Patent: Aug. 23, 1994

[54] MOBILE SILHOUETTE TARGET DEVICE WITH REMOTE RESETTING MEANS

[76] Inventor: David J. Reinart, 29238 Schwartz Rd., Westlake, Ohio 44145

[21] Appl. No.: 979,622

[22] Filed: Nov. 19, 1992

[51] Int. Cl.[5] ..... F41J 7/00

[52] U.S. Cl. ..... 273/391

[58] Field of Search ..... 273/391, 392

[56] References Cited

U.S. PATENT DOCUMENTS

| | | | |
|---|---|---|---|
| 3,647,214 | 3/1972 | Hohmann | 273/392 |
| 4,426,085 | 1/1984 | Dixon | 273/392 |
| 4,540,182 | 9/1985 | Clement | 273/392 |
| 4,588,194 | 5/1986 | Steidle et al. | 273/391 |
| 4,614,345 | 9/1986 | Doughty | 273/392 X |
| 4,714,256 | 12/1987 | Mosser | 273/392 |
| 4,739,996 | 4/1988 | Vedder | 273/392 |
| 4,773,652 | 9/1988 | Mosser | 273/392 |
| 4,807,888 | 2/1989 | Pidde et al. | 273/392 |
| 4,949,980 | 8/1990 | Hoy | 273/391 |

*Primary Examiner*—William H. Grieb

[57] ABSTRACT

A mobile target assembly with a plurality of steel silhouette targets. A remote controlled target device that resets the targets by pulling a cord. A pivot bar extending across the steel housing which is hinged to permit the steel silhouettes to revolve to a knock down position when hit. An arm is attached to a pair of bars which is attached to the pivot bar lifts the targets to their upright position when pulled with a cord. A horizontal wood support with two legs. One leg has wheels for ease in moving the heavy silhouette targets. When not in use the legs are hinged and fold up for storing. A device that is made for rim-fire and center fire guns and also air fire guns.

7 Claims, 4 Drawing Sheets

MOBILE SILHOUETTE TARGET DEVICE WITH REMOTE RESETTING MEANS

FIELD OF INVENTION

This invention relates to silhouette target devices capable of being reset from a distance that can be used indoors and outdoors.

BACKGROUND OF INVENTION

Silvetas metalicas in which steel silhouettes shaped like game animals and birds are used as targets was introduced into the southwestern United States from Mexico in the 1960's. These targets were manually raised and set up to prepare them for additional use. It was time consuming to go to the targets, right the silhouette target, and return. The manual movement to and from the target by the target setter can also be dangerous. This is especially dangerous where there are others using nearby target ranges and shots may go astray. In the last ten years steel silhouettes target shooting has become very popular. Steel offers sound reaction and long lasting targets. Target practice with the above described target can be more enjoyable than the traditional bullseye target printed on paper. In the last ten years many devices have automatic reset means to reposition the targets to an upright position. Illustrated in U.S. Pat. Nos. 4,807,888; 4,426,085; and 4,540,182. Many targetshooters do not have access to these devices. Also the complex designs make them too expensive to produce economically. In prior target assemblies there may be only one target to shoot as in U.S. Pat. Nos. 4,614,345; 4,714,256; 4,739,996; and 4,773,652. This makes the shooting of rapid fire impractical and time consuming.

Still other types of target devices having a set of targets with a reset by striking a reset target as in U.S. Pat. No. 4,949,980; or using a cord to reset targets in U.S. Pat. No. 4,588,194. There is a need for this mobile target with remote reset to reposition the silhouette targets to an upright position. There is ease in changing the different size silhouette targets. A target device which could be used at one's home for example in a garage as well as in the field. A device that is made for rim fire, center fire caliber guns, and also air fire guns. None of the prior art has all the features that this Mobil-Silhouette device has.

SUMMARY OF THE INVENTION

The invention is a mobile silhouette target device. This mobile silhouette target is able to reset targets from a distance that have been knocked down. The target device is comprised of a housing with multiple silhouette targets on a pivot bar extending across the housing. The silhouette targets have a face, base, and pipe hinge which is attached to the pivot bar to permit revolving movement of the targets to a knock down position when hit by a bullet, pellet, or projectile. A target reset for remotely moving the targets from a knock down position to upright position comprises: An arm that is attached to a pair of bars positioned behind the pivot bar, which is attached to the pivot bar. The targets are hit and knocked down onto the pair of bars positioned behind the pivot bar. The targetshooter pulls on the cord that is attached to the arm which lifts the pair of bars and targets to their upright position. A spring is attached to the arm which pulls the arm back to its horizontal or knocked down target position. The silhouette targets, pivot bar, housing, and reset arm and bars are attached to a wood horizontal base with two legs. One leg has wheels for ease in moving the heavy silhouette targets. A handle is notched out of the wood on the end of the horizontal base opposite the wheel leg. The legs are hinged to the horizontal base for folding up and storing. The leg with wheels has two steel rods going through the base and leg for support along with the hinges. The other leg has a wire cable attached to it to keep the leg in a vertical position along with the hinges.

DETAILED DESCRIPTION OF THE INVENTION

Figure 1:
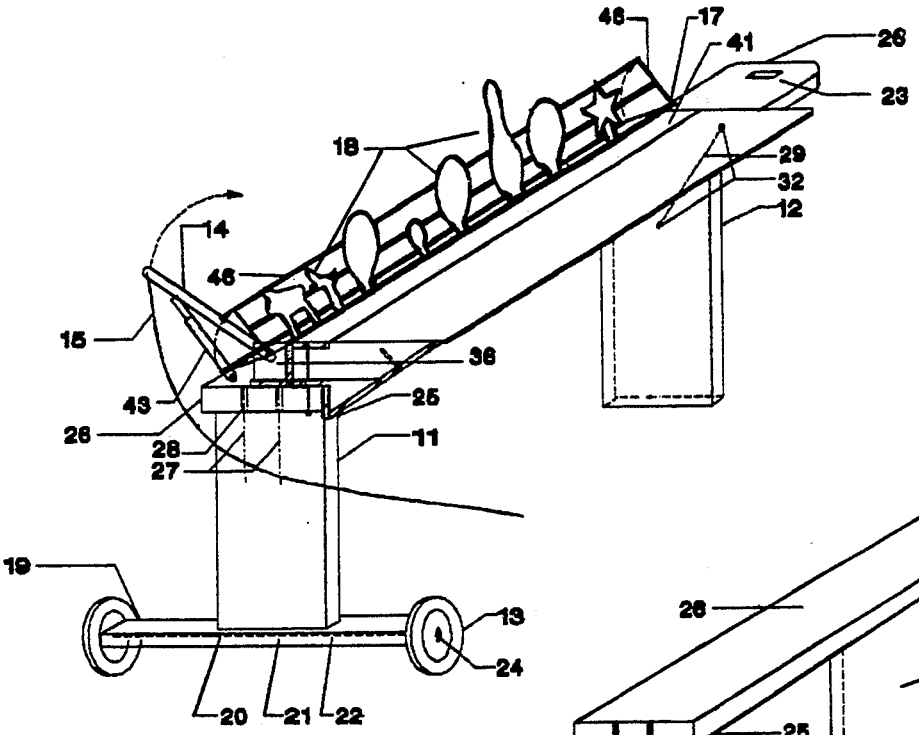
FIG. 1 is a view of the target device with remote resetting means.
Figure 2:
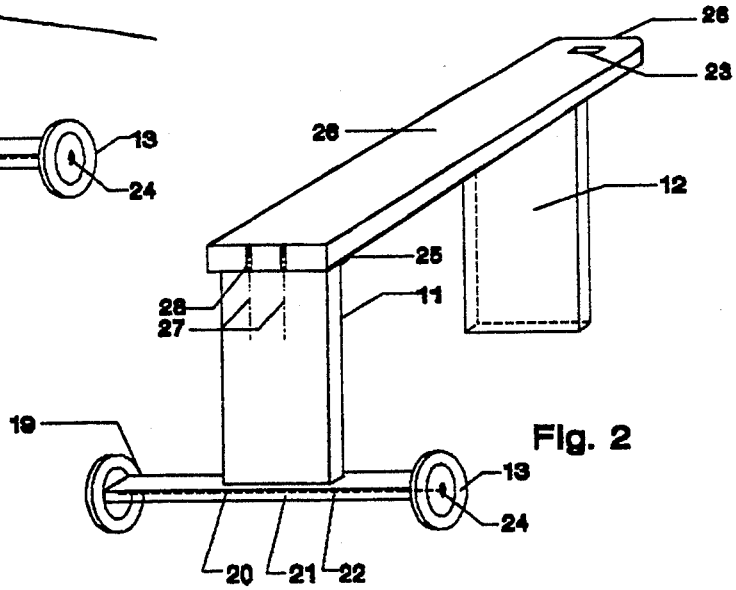
FIG. 2 is a end view of the wood base, legs, and wheels.
Figure 3:
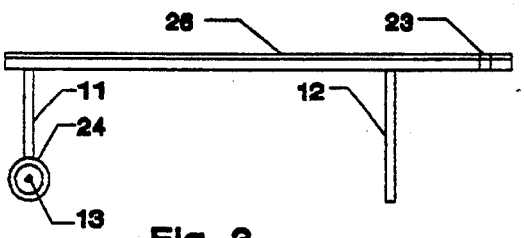
FIG. 3 is a front view of the wood base, legs, and wheels.

Referring to drawing FIG. 1 is mobile target[10] device that can be used at an inside or outside location. A cord[15] is attached to a reset arm[14] which leads to the targetshooter. When the targetshooter hits the targets[18] the targets[18] are knocked backward to a down position. After all targets[18] are hit the cord[15] is pulled by the targetshooter from his original position of fire. The targets[18] are reset and ready for additional target shooting. FIG. 2 is the support for the targets[18] and targets housing[17]. The base support[26] consists of two legs. One of the legs[11] has wheels[13] and the other leg[12] is for support. The leg with wheels[13] has a wood support axle[19] which is glued and nailed to the leg[11]. An axle rod[21] pipe housing[20] is attached to the under side of the wood support axle[19] by metal pipe clamps[22]. The axle rod[23] is then put through the axle rod[21] and pipe housing[20]. Once through the pipe[20] a washer is added and then the wheels[13] a washer and then axle rod[21] and an end cap[24] to keep wheel[13] on. The two legs[11] and [12] are hinged[25] to the housing base support[26]. The wheel leg[11] support has two anchor bolts[27] going through the base[26] into the leg[11]. The anchor bolt[27] goes through a sleave flange[28] which is glued onto the base[26]. This keeps the leg from becoming loose. An eyebolt[27] is attached to the support leg[12] and the under side of the base[26]. A cable[29] is attached to the base eyebolt[32] and snap[31] is attached to the eyebolt[32] on the leg.

Figure 4:
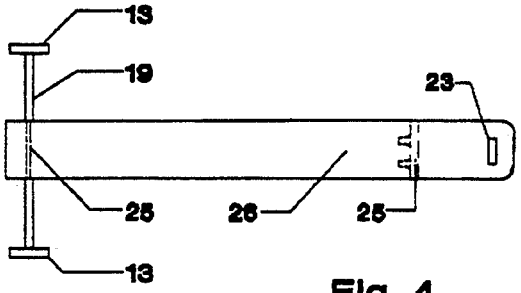
FIG. 4 is a top view of the wood base, legs, and wheels.
Figure 5:
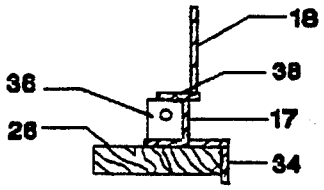
FIG. 5 is an end view of the wood base silhouette housing, pivot bar, and steel wood protector.

FIG. 4 An opening[33] is made at the far end of the base[26] for a handle[23]. FIG. 5 Shows the end of the wood support base[26]. Steel wood protector[34] pivot housing[35] support and pivot block[36] are welded together. Silhouette[37], base[38], and pipe hinge[39] are welded together.

Figure 6:
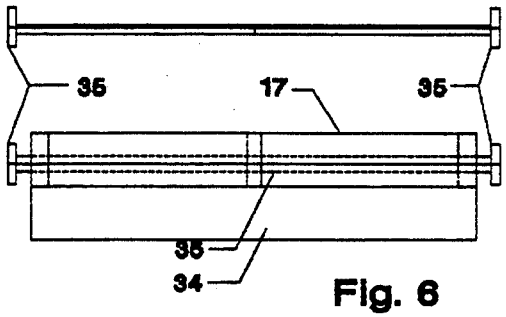
FIG. 6 is a front and top view of the silhouette housing pivot bar and steel wood protector.

FIG. 6 Shows the face of steel wood protector[34], target housing[17] and pivot bar[35].

DETAILED DESCRIPTION OF INVENTION

Figure 7:
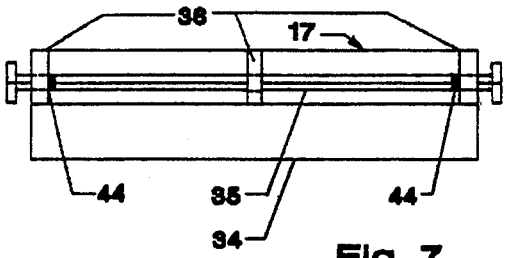
FIG. 7 is an end view of the reset arm and bars.

FIG. 7 Shows a top view of the steel wood protector[34], target housing[17], pivot housing blocks[36], and pivot bars[35].

Figure 8:
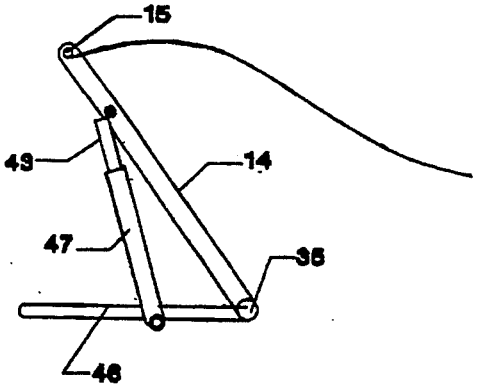
FIG. 8 is a front view of the reset arm and bars in a reset position.

FIG. 8 shows the end view of the reset arm[14] and bars[40], hole for the pivot bar[43] and hole for the cord[15], hole for the reset spring[43].

Figure 9:
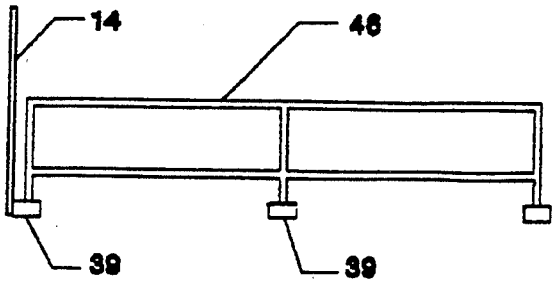
FIG. 9 is an end view of the wood base legs, wheels, silhouettes, housing pivot bar, rest arm and bars.

FIG. 9 is the reset arm[14] and bars[40] with pipe hinge[39] welded to them.

Figure 10:
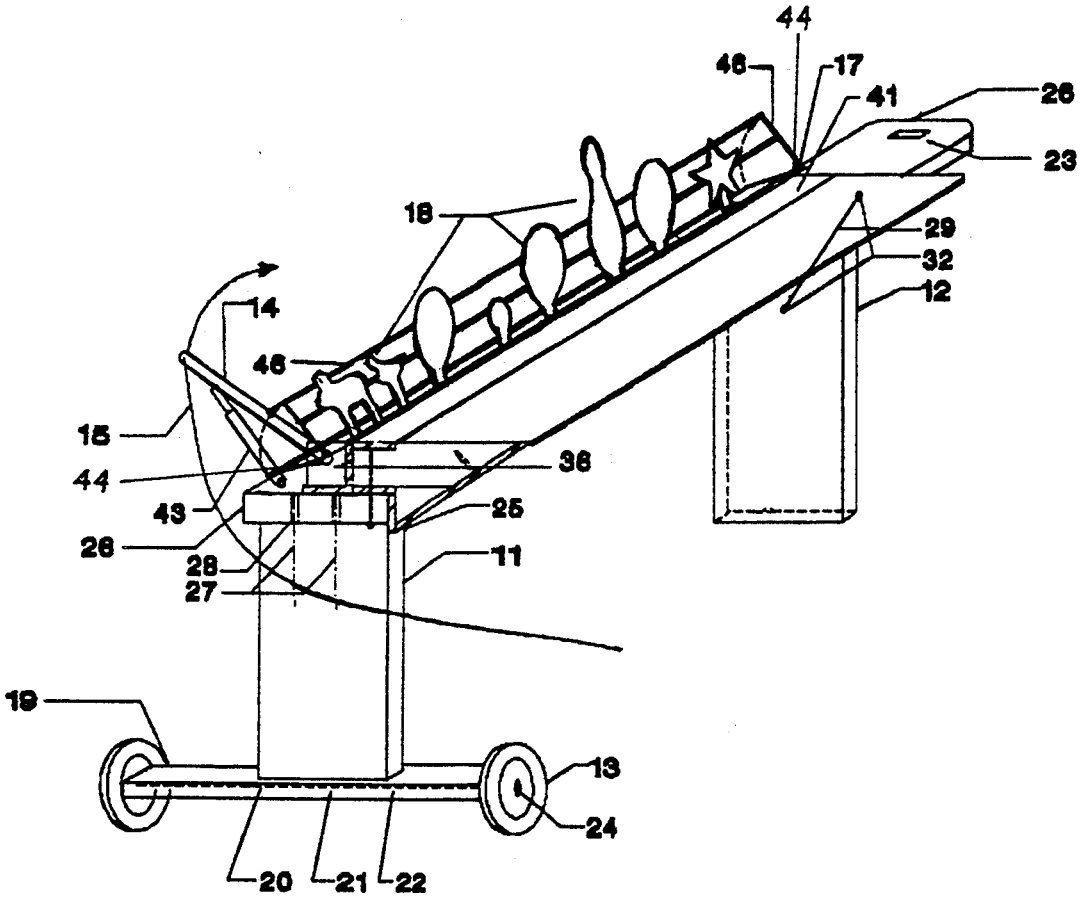
FIG. 10 is a front and side view of the wood base, legs, wheels, silhouettes, housing, and pivot bar, reset arm, and bars.

FIG. 10 Shows the mobile target device with different types of silhouette targets[18] on it with the reset arm[14] pulled to reset the targets[18].

Figure 11:
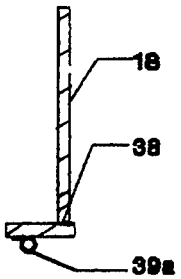
FIG. 11 is a side view of a silhouette base and pipe hinge.

FIG. 11 Shows the side of a silhouette target with base plate[38] and pipe hinge[39].

Figure 12:
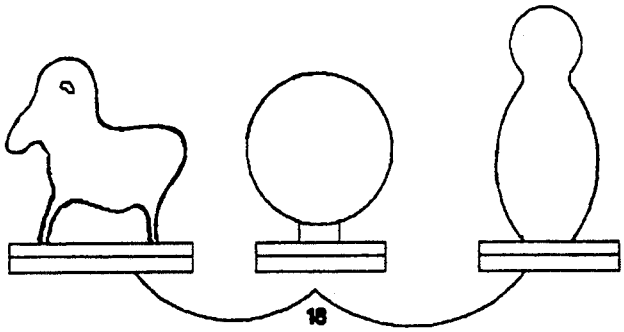
FIG. 12 is a front view of a animal, disk and bowling pin silhouette with base and pipe hinge.

FIG. 12 Shows the face of different types of silhouettes[18] with base plate[38] and pipe hinge[39].

In FIG. 10 the shooter can change the targets[18] by unscrewing a fitting[44] on the pivot bar. One slides the bar out from each end of the housing[27]. When putting new targets[18] in one slides the pivot bar[43] through the pivot support block[36] through the target[18] pivot hinge[39] through P.V.C. pipe or pipe tubing[45] for spacers between the targets[18] then through the pivot support block[36] again.

Figure 13A:
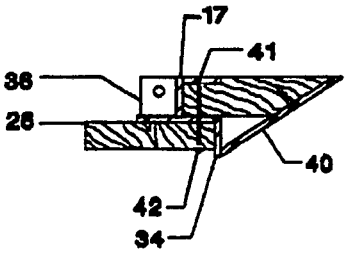
FIG. 13A is a center fire bullet deflector which can be attached to the wood protector.
Figure 13B:
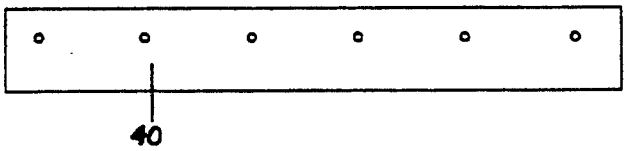
FIG. 13B is a front view of FIG. 13A.

FIG. 13 Shows the side view of the wood support base[26], wood base protector[34] top plate wood protector[41], attaching bolt[42] and front view of the wood base protector[40].

What is claimed:

1. A mobile target base device comprising;

A. a housing with an open front, back and sides, capable of withstanding the impact of a projectile, B. a horizonal pivot bar extending through the housing, C. a plurality of targets positioned in a normally upright position on said pivot bar at spaced intervals, said targets each comprised of a target face, a base, and pivot means mounted off-center of the target face and which permits the target to pivot to a knock-down position when hit by a projectile, D. the target bases being supported by the housing when the target is in the normal upright position, E. return means for resetting the targets from the knock-down position to the normally upright position, said return means comprising;

1. a plurality of reset bars positioned behind and attached to the pivot bar by connecting means, and normally in a reset position,
2. an arm attached at one end to the connecting means,
3. a cord attached to the other end of said arm and then to a remote location, whereby a pull on the cord will cause the reset bars to move from their reset position and lift the targets back to their normally upright position,
4. and a spring attached to the outermost part of the arm to return the reset bars to their rest position when the pull on the cord is removed.

2. The mobile target device of claim 1, wherein said targets are each attached to said pivot bar by a cylindrical tube attached to said base of said target, said pivot bar extending through said cylindrical tubes.

3. The mobile target device of claim 1, wherein said housing comprises blocks with holes therethrough to support the pivot bar, said bar being removable from said blocks and housing.

4. The mobile target device of claim 1, further comprising a horizontal support below said housing, and two vertical support legs beneath said horizontal support, one of said support legs having wheels at its lower end to permit the target device to be rolled.

5. The mobile target device of claim 4, further comprising hinge means for permitting said vertical support legs to be pivoted to a horizontal position underneath said housing, in order to facilitate storage.

6. The mobile target device of claim 4, further comprising an opening at one end of said horizontal support to serve as a hand grip to aid in rolling said target device.

7. The mobile target device of claim 1, further comprising a projectile deflector mounted on said housing so as to protect the housing from damage by errant shots.

* * * * *